US010689917B2

(12) United States Patent
Emerson et al.

(10) Patent No.: US 10,689,917 B2
(45) Date of Patent: Jun. 23, 2020

(54) SIMPLIFIED PACKER PENETRATOR AND METHOD OF INSTALLATION

(71) Applicant: QUICK CONNECTORS, INC., Houston, TX (US)

(72) Inventors: Tod D Emerson, Magnolia, TX (US); Jim Williams, Montgomery, TX (US); Elizabeth McClain, Houston, TX (US)

(73) Assignee: QUICK CONNECTORS, INC., Houston, TX (US)

( * ) Notice: Subject to any disclaimer, the term of this patent is extended or adjusted under 35 U.S.C. 154(b) by 0 days.

(21) Appl. No.: 15/778,765

(22) PCT Filed: Nov. 25, 2016

(86) PCT No.: PCT/US2016/063773
§ 371 (c)(1),
(2) Date: May 24, 2018

(87) PCT Pub. No.: WO2017/091813
PCT Pub. Date: Jun. 1, 2017

(65) Prior Publication Data

US 2018/0347287 A1 Dec. 6, 2018

(51) Int. Cl.

| | |
|---|---|
| ***E21B 17/02*** | (2006.01) |
| ***H01R 13/52*** | (2006.01) |
| ***H01R 13/533*** | (2006.01) |
| ***E21B 33/02*** | (2006.01) |

(52) U.S. Cl.
CPC ..... *E21B 17/023* (2013.01); *E21B 33/02* (2013.01); *H01R 13/5205* (2013.01); *H01R 13/533* (2013.01)

(58) Field of Classification Search
CPC ..... E21B 17/023; E21B 33/02
See application file for complete search history.

(56) References Cited

U.S. PATENT DOCUMENTS

| | | | | |
|---|---|---|---|---|
| 5,478,970 | A | 12/1995 | Lawler et al. | |
| 5,833,490 | A * | 11/1998 | Bouldin | E21B 17/023 439/462 |
| 6,305,944 | B1 * | 10/2001 | Henry | E21B 17/01 439/13 |
| 2002/0088623 | A1 | 7/2002 | Fielder, III et al. | |
| 2004/0134667 | A1 * | 7/2004 | Brewer | E21B 17/023 166/380 |
| 2008/0087466 | A1 | 4/2008 | Emerson | |
| 2009/0090517 | A1 * | 4/2009 | Jackson | E21B 17/003 166/385 |
| 2010/0089588 | A1 | 4/2010 | Thompson | |

FOREIGN PATENT DOCUMENTS

| | | |
|---|---|---|
| WO | WO2014/185958 | 11/2014 |

* cited by examiner

*Primary Examiner* — David J Bagnell
*Assistant Examiner* — Dany E Akakpo
(74) *Attorney, Agent, or Firm* — MH2 Technology Law Group LLP

(57) ABSTRACT

A packer penetrator assembly comprised of a proximal mandrel, an intermediate mandrel and a distal mandrel that can be quickly and efficiently assembled while preventing the migration of gases or fluids up the ESP cable through a well bore packer. These ESP cables can be spliced to power cables passing through a wellbore packer, a sealed electrical connection at a packer assembly. The packer penetrator also offers an adaptive or male to female crossover assembly that allows use of power cables of differing diameters and styles to be joined.

17 Claims, 8 Drawing Sheets

SIMPLIFIED PACKER PENETRATOR AND METHOD OF INSTALLATION

FIELD OF INVENTION

The present invention relates to a new form of electrical connector arrangement; more specifically, to a new packer penetrator permitting electrical conductors to be installed passing through a packer system within a well bore.

BACKGROUND OF THE INVENTION

Previously, connecting an Electrical Submersible Pump cable to a well bore packer was a time consuming and difficult task with the possibility that, once finished, the packer penetrator and splice of the cable would still allow leaks, grime and pressure to travel up the power cable and short or interfere with the operation of the ESP. With the present invention, many of these issues are solved; allowing a quicker, cleaner installation of a packer penetrator with the electrical power supply cables that will effectively seal against water, gases and grit found inside the wellbore.

SUMMARY OF THE INVENTION

Figure 1:
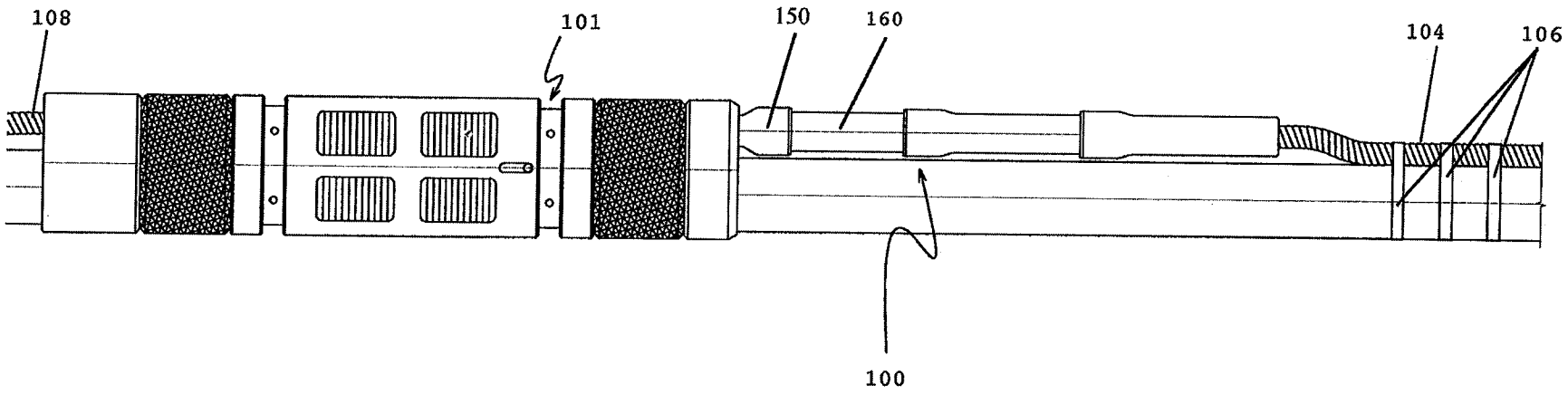
FIG. 1 is a schematic drawing of the reusable packer penetrator of the present invention inserted in a packer body guiding ESP cables from below the packer to the top side of the production string through a male to female pipe adapter, which may also be used to adjust the diameter of the penetrator.

The present invention is a packer penetrator consisting of three metallic mandrels. The distal mandrel consists of a metallic threaded mandrel through which a stripped armored cable is fed through and seated into that distal mandrel using O-rings, a metallic sleeve and an elastomeric seal. The distal mandrel is filled with epoxy to further seal the mandrel. The cable to be spliced is pulled through the packer and fed through the proximal mandrel. The proximal mandrel either threaded directly into the packer if the diameter of the hole in the packer will allow it or more commonly by using a male to female threaded adapter. The cable is then spliced to the cable from the distal mandrel and inserted into the intermediate mandrel which is either directly threaded onto the proximal mandrel or the male to female crossover, and occasionally instead of a direct thread, a locking nut is used to connect the intermediate mandrel to the proximal mandrel. Before the intermediate mandrel is connected to the proximal mandrel, it is filled with dielectric grease to improve the conductivity of the splice and prevent grit or fluids from damaging the connection.

An electrical connector packer penetrator comprising a proximal mandrel sealingly connected to a well bore packer; an intermediate mandrel sealingly connected to the proximal mandrel providing an insulated electrical connector body; and a distal mandrel to sealingly connected to the electrical conductors and to the intermediate mandrel. The electrical connector packer penetrator can further comprise a male to female crossover connected between the packer and the proximal mandrel. The electrical connector packer penetrator can further comprise a proximal mandrel connected to an intermediate mandrel by a threaded lock nut engaging a shoulder of the intermediate mandrel centralizing an insulated electrical connection. The intermediate mandrel may be filled with a dielectric grease, and the electrical connector packer penetrator can also provide a sleeve in the proximal mandrel and the distal mandrel which can both be filled with epoxy.

This application also claims a method for installing an electrical connector packer penetrator comprising the steps of stripping the ends off of each electrical conductor from an armored cable from a well bore; stripping the ends off of each electrical conductor from a second armored cable inserted in a well bore; inserting each of the electrical conductors of the second armored cable through a packer and into an proximal mandrel attached to the packer; fitting each of the electrical conductors in stainless steel tubes and inserting them into an elastomeric seal body; seating the stainless steel tubes in a top stop within the proximal mandrel; covering each conductor with epoxy leaving the exposed ends of the electrical conductors for connection to the exposed conductors proceeding from the well bore; connecting each of the conductors to its corresponding conductor with a crimp socket and covering a crimp socket with a dielectric insulator within the intermediate mandrel; filling the intermediate mandrel with a dielectric grease; and, sealingly connecting the intermediate mandrel containing the electrical connector socket to the proximal mandrel.

DETAILED DESCRIPTION OF SEVERAL EMBODIMENTS OF THE INVENTION

FIG. 1 shows the packer penetrator 100 of the present invention with the male to female cross-over 150 emerging from the packer 101 and threaded to the proximal mandrel 160. Power cable 104 is banded to the production tubing by bands 106 in a well known manner and connected inside the packer penetrator 100 to the up-hole power cable 108.

Figure 2:
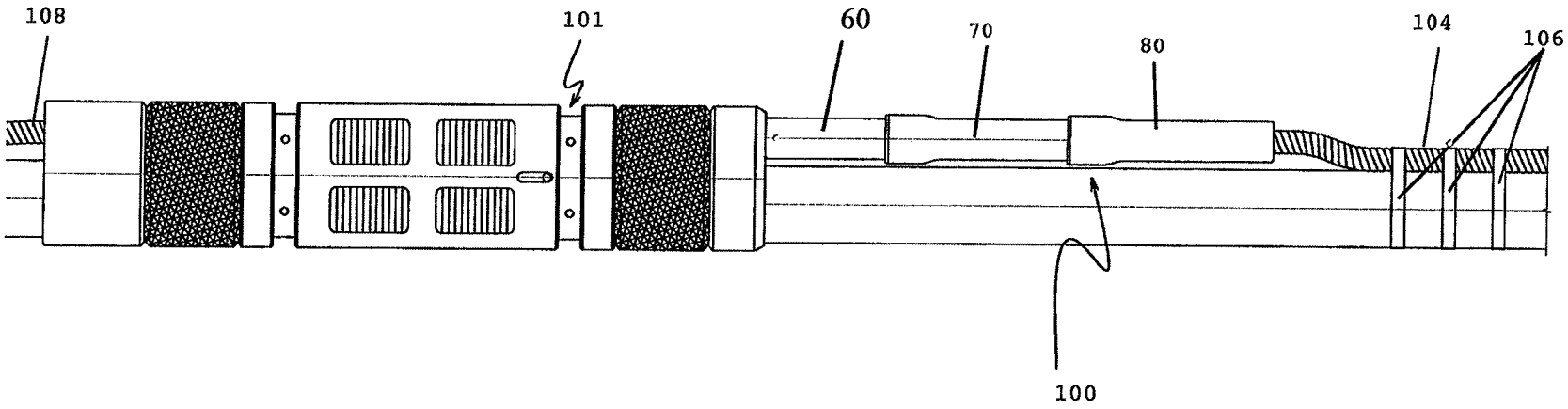
FIG. 2. is a schematic drawing of an alternative embodiment of a reusable packer penetrator of the present invention inserted in a packer body guiding ESP cables from below the packer to the top side of the production string.

FIG. 2 shows the packer penetrator 100 of the present invention threaded into an inflatable packer 101 with power cable 108 running into the packer penetrator from topside. Power cable 104 is banded 106 to the production tubing in a manner well known in this art. A proximal mandrel 60 is threaded directly into the packer penetrator 100 and connected to the intermediate mandrel 70 which is connected to the distal mandrel 80.

Figure 3:
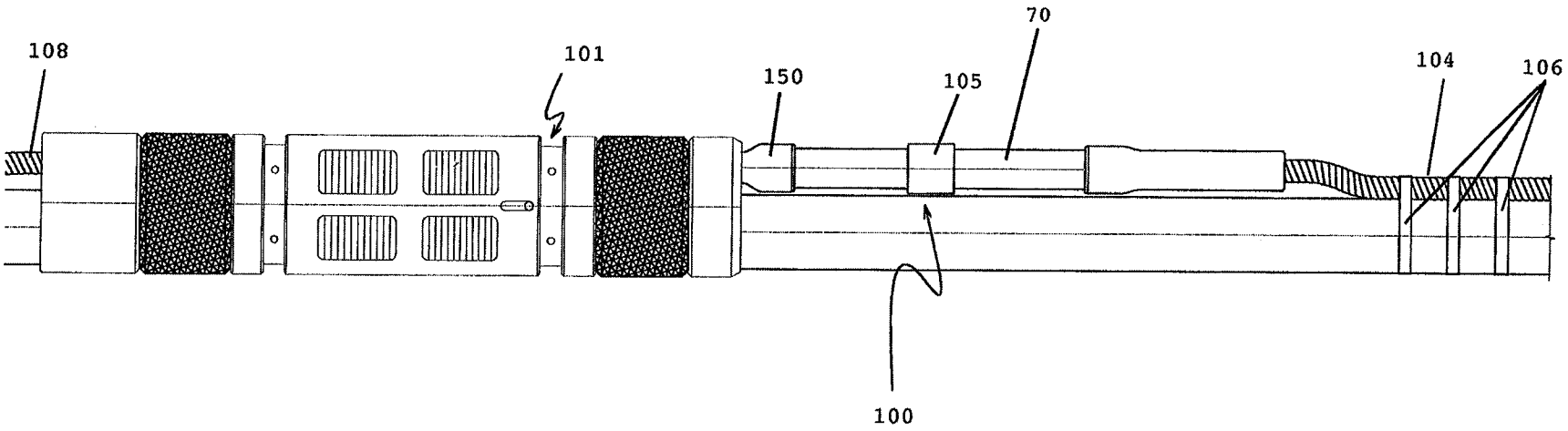
FIG. 3 is a schematic drawing of yet another embodiment of a reusable packer penetrator of the present invention inserted in a packer body guiding ESP cables from below the packer to the top side of the production string through a male to female pipe adapter, which may also be used to adjust the diameter of the penetrator, with a locking nut connector sealing the adapter mandrel and the intermediate mandrel.

FIG. 3 shows the packer penetrator 100 of the present invention with the male to female cross-over 150 emerging from the packer 101. Power cable 104 is banded 106 to the production tubing in a well known manner and connected inside the packer penetrator 100 to the up-hole power cable 108. The male to female cross-over 150 is connected to the intermediate mandrel 70 using a threaded lock nut 105.

Figure 4:
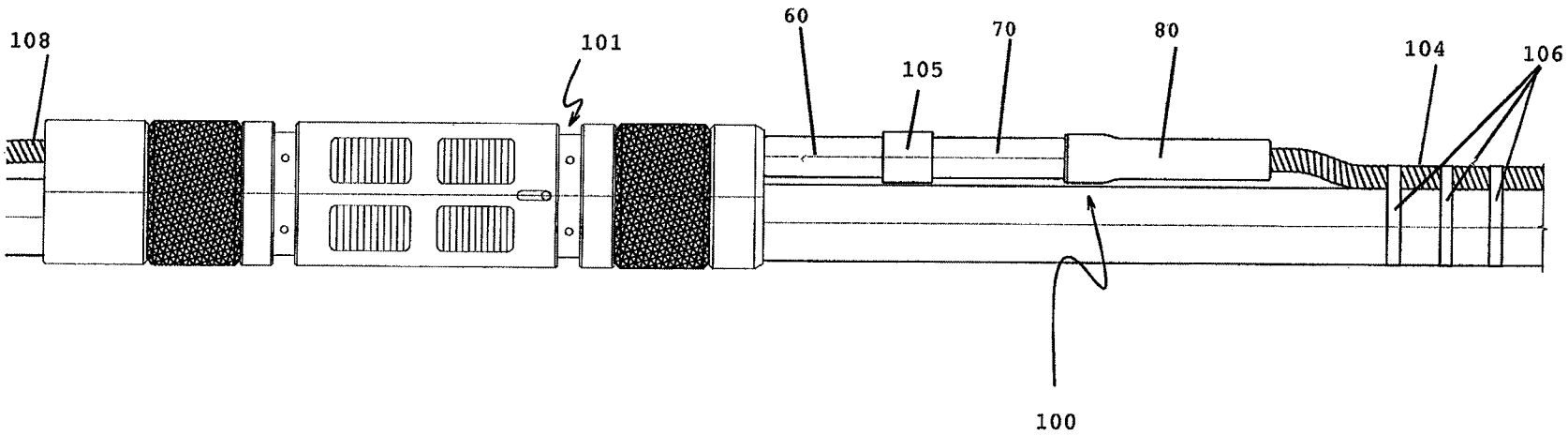
FIG. 4 is a schematic drawing of still another embodiment of a reusable packer penetrator of the present invention inserted in a packer body guiding ESP cables from below the packer to the top side of the production string, that has a locking nut connector sealing the adapter mandrel and the intermediate mandrel.

FIG. 4 shows the packer penetrator 100 of the present invention threaded into an inflatable packer 101, with power cables 108 running into the packer penetrator from topside, and connected to the intermediate mandrel 70 using a threaded lock nut 105, which connects with a proximal mandrel 60. The assembly is then connected to the distal mandrel 80. Power cable 104 is again banded 106 to the production tubing in a manner well known in this art.

Figure 5:
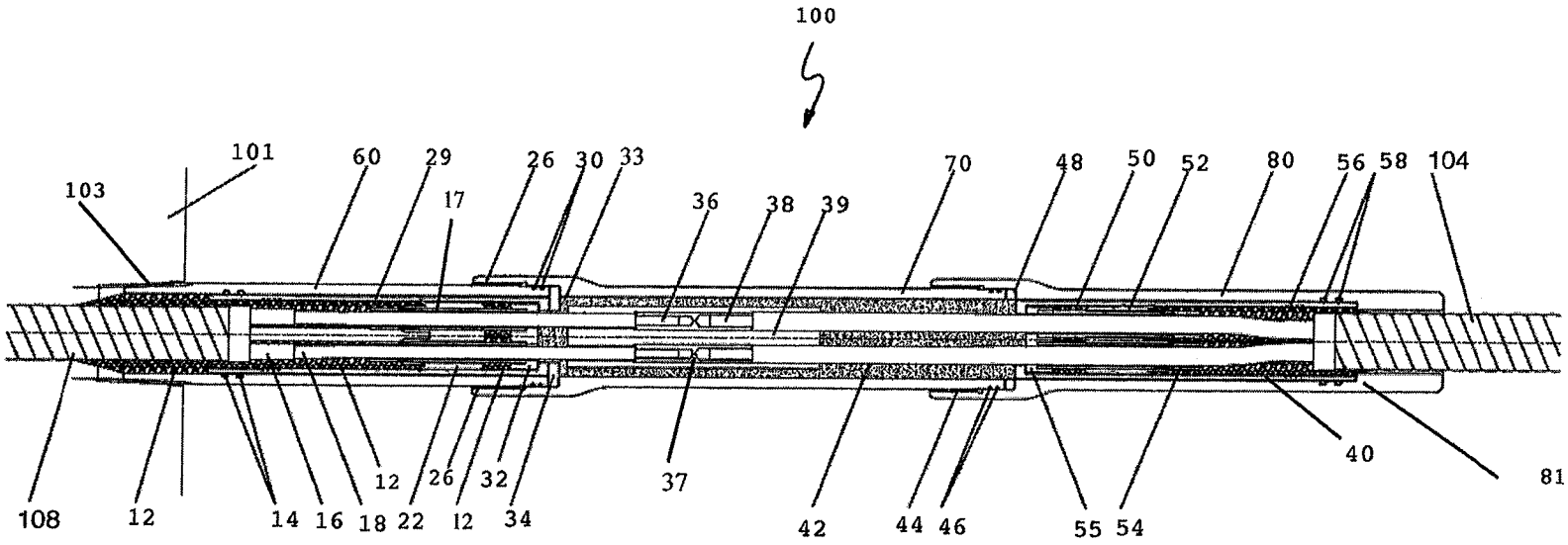
FIG. 5 is a cross-sectional view of an embodiment of the packer penetrator as found in FIG. 2.

FIG. 5 is a cross-sectional view of the interior of a packer penetrator 100 of one embodiment as shown in FIG. 2. Power cable 108 is stripped of its armor and its three conductors 18 (of which only two are shown in the drawings) are inserted into an adapter mandrel 60 threaded to the packer body 101. Each conductor is inserted into a stainless steel tube 29 into which is inserted an elastomeric seal 22. Each conductor 18 is inserted into an inner sleeve 17, made of stainless steel and seated in a metal bushing 32 providing holes for the continued passage of the electrical conductors. Epoxy 12, 56 is used to fill the gap around the armored power cable at each end of the packer penetrator 100 to anchor power cables 108 and 104 to the packer penetrator 100. Sleeve 29 fits within the proximal mandrel 60 and is prevented from further movement by bushing 34 set between the shoulder 33 of the intermediate mandrel 70, which carries a connector socket 37 for mating the electrical conductors 36, 38 in a dielectric body 39, and the proximal mandrel 60. Connector nut 32 is threaded onto proximal mandrel 60 and is filled with dielectric grease 42.

A distal mandrel 80 attaches to the intermediate mandrel 70 by threads 44 and accepts the electrical conductors carried in armored power cable 104 in the manner similar to those coming from the packer 101. The distal mandrel 80 seals to the intermediate mandrel 70 with O-rings 46. A sleeve 40 having O-rings 58 at its proximal end carries the electrical conductors into stainless steel tubing or sleeves 54 through an elastomeric seal 52 and seating in a metallic seat 55. Epoxy 50 is disposed within the space between the elastomeric seal 52 and the adjacent end of sleeve 40. The sleeve 40 within distal mandrel 80 seats against an internal shoulder 81. Epoxy 56 again is put into the sleeve 40 sealing both the tubes 54, and the conductor coming from the armored cable 104. All other parts similarly situated are the same and function in the same manner as previously described.

Figure 6:
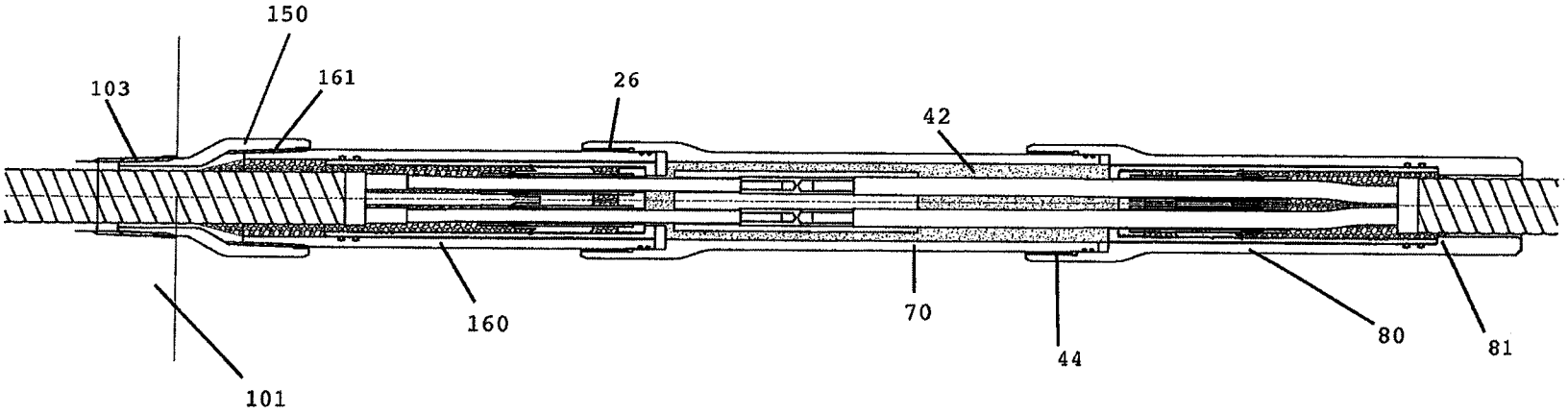
FIG. 6 is a cross-sectional view of yet another embodiment of the packer penetrator showing a male to female cross-over as shown in FIG. 1.

FIG. 6 is a cross-sectional view of the interior of the packer penetrator as shown in FIG. 1 showing the connection to a male to female cross-over 150 which is threaded 103 on the packer 101. A proximal mandrel 160 threads 161 to the male to female cross-over 150 joining the female end of the intermediate mandrel 70. That assembly threads 44 to the distal mandrel 80. The female end of the intermediate mandrel 70 is threaded 26. The intermediate mandrel 70 is filled with dielectric grease 42 in each instance and functions to protect the electrical connection and the insulator body from damage from the exterior conditions of the well bore.

Figure 7:
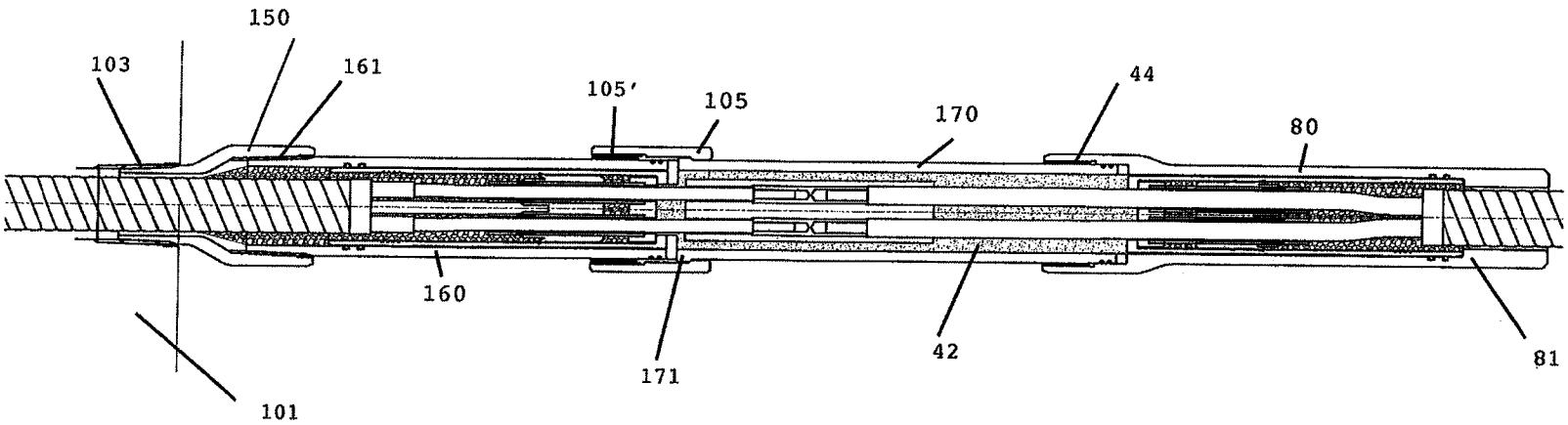
FIG. 7 is a cross-sectional view of yet another embodiment of the packer penetrator showing a male to female cross-over and using the lock nut as shown in FIG. 3.

Alternatively, FIG. 7 shows a threaded 105' locking nut 105 connecting the proximal mandrel, 160 to the intermediate mandrel 170. The threaded lock nut 105 has internal threads 105' to allow it to connect to the proximal mandrel 160 and the intermediate mandrel 170. The proximal mandrel 160, threads 161 into the male to female cross-over 150, and threads into the packer bodies 101 using threads 103. Additionally, the intermediate mandrel 170, has a shouldered end 171 to allow it to engage the threads 105' of the locking nut 105.

Figure 8:
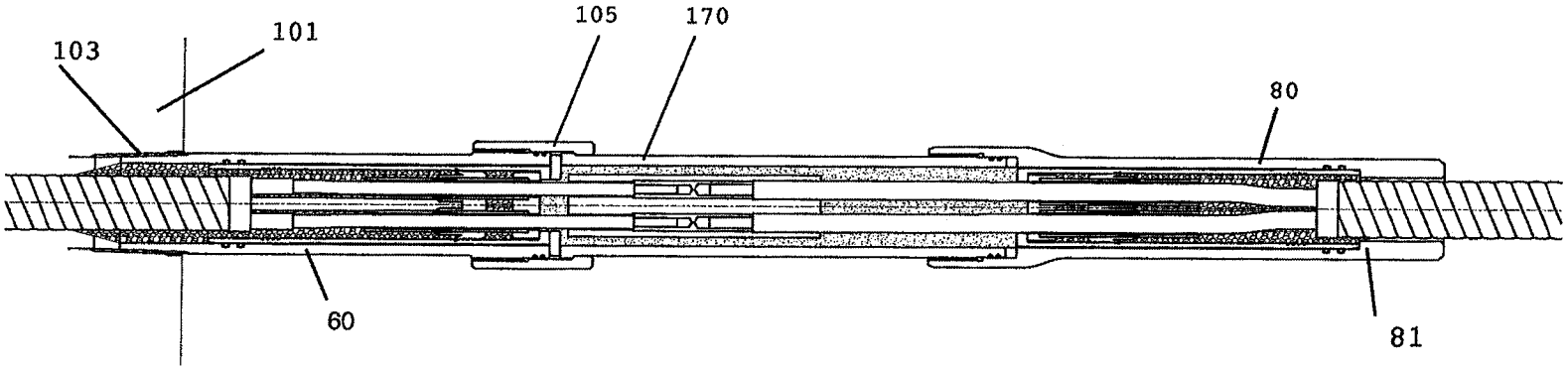
FIG. 8 is a cross-sectional view of an alternative embodiment of the packer penetrator as found and using the lock nut as shown in FIG. 4.

Alternatively, FIG. 8 shows a threaded 105' locking nut 105 connecting the proximal mandrel 60, to the intermediate mandrel 170. The threaded lock nut 105 has internal threads 105' to allow it to connect to the proximal mandrel 60 and the intermediate mandrel 170. The proximal mandrel 60, threads directly into the packer bodies 101, on internal threads 103, or uses a male to female cross-over 150, to connect to the proximal mandrel 160. Additionally, the intermediate mandrel 170, has a shouldered end 171 to allow it to engage the threads 105' of the locking nut 105.

The invention claimed is:

1. An electrical connector packer penetrator comprising:

a proximal mandrel sealingly connected to a well bore packer and configured to receive a first armored cable therein, wherein the first armored cable comprises a first plurality of electrical conductors and an armor surrounding a portion of the first plurality of electrical conductors;

an intermediate mandrel sealingly connected directly to the proximal mandrel, or connected to the proximal mandrel via a coupling member that is received around and directly connected to the proximal mandrel and the intermediate mandrel, the intermediate mandrel providing an insulated electrical connector body; and a distal mandrel sealingly connected to the intermediate mandrel, the distal mandrel being configured to receive a second armored cable therein, the second armored cable comprising a second plurality of electrical conductors and an armor surrounding a portion of the second plurality of electrical conductors, wherein the intermediate mandrel is configured to receive stripped ends of the first electrical conductors, and stripped ends of the second electrical conductors, and to electrically connect the first plurality of electrical conductors with the second plurality of electrical conductors within the intermediate mandrel.

2. The electrical connector packer penetrator of claim 1 further comprising a male to female crossover connected between the packer and the proximal mandrel.

3. The electrical connector packer penetrator of claim 1 further comprising the coupling member that is directly connected to the proximal mandrel and the intermediate mandrel, wherein the coupling member comprises a threaded lock nut, and wherein the threaded lock nut engages a shoulder of the intermediate mandrel so as to centralize an insulated electrical connection therebetween.

4. The electrical connector packer penetrator of claim 1 wherein the intermediate mandrel is filled with a dielectric grease.

5. The electrical connector packer penetrator of claim 1 wherein a sleeve in the proximal mandrel is filled with epoxy, and wherein a sleeve in the distal mandrel is filled with epoxy.

6. The electrical connector packer penetrator of claim 1 further comprising a plurality of tubes positioned in the proximal mandrel, wherein the plurality of tubes are each configured to receive one of the first plurality of electrical conductors therethrough, and wherein an epoxy is positioned around at least a portion of the plurality of tubes.

7. The electrical connector packer penetrator of claim 6 further comprising a bushing positioned between the proximal mandrel and the intermediate material, wherein the bushing is configured to receive the first plurality of electrical conductors therethrough, and wherein the bushing engages the plurality of tubes, to secure a position of the plurality of tubes in the proximal mandrel.

8. The electrical connector packer penetrator of claim 1 wherein an end of the proximal mandrel is received at least partially in an end of the intermediate mandrel.

9. The electrical connector packer penetrator of claim 1 wherein an end of the intermediate mandrel is connected directly to an end of the distal mandrel.

10. The electrical connector packer penetrator of claim 1 further comprising an outer sleeve that sealingly engages a bore of the distal mandrel and seats against a shoulder of the distal mandrel, wherein the armor of the second armored cable is received into the outer sleeve, such that the second plurality of electrical conductors extend therefrom within the outer sleeve.

11. The electrical connector packer penetrator of claim 10 further comprising a plurality of inner sleeves positioned within the outer sleeve and configured to receive the second plurality of conductors therethrough.

12. The electrical connector packer penetrator of claim 11 further comprising an elastomeric seal positioned around the inner sleeves and sealing with the plurality of inner sleeves and outer sleeve.

13. The electrical connector packer penetrator of claim 12 further comprising a seat in the distal mandrel configured to secure a position of the plurality of inner sleeves.

14. The electrical connector packer penetrator of claim 13 further comprising an epoxy filling a volume between the elastomeric seal and the seat, and filling a volume around the plurality of inner sleeves between the elastomeric seal and the shoulder of the distal mandrel.

15. The electrical connector packer penetrator of claim 1 wherein the distal mandrel is configured to seal with the armor of the second armored cable.

16. A method for installing an electrical connector packer penetrator comprising the steps of:

stripping ends of electrical conductors of a first armored cable extending in a well bore;

stripping ends of electrical conductors of a second armored cable inserted in the well bore;

inserting each of the electrical conductors of the second armored cable through a packer and into a proximal mandrel attached to the packer;

fitting each of the electrical conductors of the second armored cable in stainless steel tubes and inserting the electrical conductors of the second armored cable into an elastomeric seal body;

seating the stainless steel tubes within the proximal mandrel;

covering each of the electrical conductors of the second armored cable with epoxy leaving the ends of the electrical conductors of the second armored cable exposed for connection to the electrical conductors of the first armored cable;

connecting each of the electrical conductors of the first armored cable to a corresponding one of the electrical conductors of the second armored cable using a socket and covering the socket with a dielectric insulator within an intermediate mandrel;

filling the intermediate mandrel with a dielectric grease; and sealingly connecting the intermediate mandrel containing the socket to the proximal mandrel.

17. The method of claim 16, wherein seating the stainless steel tubes within the proximal mandrel comprises seating the stainless steel tubes in a bushing secured between the proximal mandrel and the intermediate material.

* * * * *